United States Patent [19]

Waugh et al.

[11] Patent Number: 4,936,045

[45] Date of Patent: Jun. 26, 1990

[54] DEMINERALIZATION OF COAL

[75] Inventors: Allan B. Waugh, Sutherland; Keith M. Bowling, Turramurra, both of Australia

[73] Assignee: Commonwealth Scientific and Industrial Research Organisation, Campbell, Australia

[21] Appl. No.: 272,048

[22] PCT Filed: Mar. 23, 1987

[86] PCT No.: PCT/AU87/00080

§ 371 Date: Sep. 19, 1988

§ 102(e) Date: Sep. 19, 1988

[87] PCT Pub. No.: WO87/05621

PCT Pub. Date: Sep. 24, 1987

[30] Foreign Application Priority Data

Mar. 21, 1986 [AU] Australia ..... PH5146

[51] Int. Cl.[5] ..... C10L 9/02

[52] U.S. Cl. ..... 44/627; 44/621

[58] Field of Search ..... 44/620, 627, 624, 621

[56] References Cited

U.S. PATENT DOCUMENTS

| | | | |
|---|---|---|---|
| 3,993,455 | 11/1976 | Reggel et al. | 44/624 |
| 4,092,125 | 5/1978 | Stambaugh et al. | 44/624 |
| 4,095,955 | 6/1978 | Stambaugh et al. | 44/624 |
| 4,134,737 | 1/1979 | Yang | 44/621 |
| 4,516,980 | 5/1985 | Wheelock | 44/624 |
| 4,569,678 | 2/1986 | Simpson | 44/627 |
| 4,582,512 | 4/1986 | Smit et al. | 44/627 |

*Primary Examiner*—Carl F. Dees

*Attorney, Agent, or Firm*—Millen, White & Zelano

[57] ABSTRACT

The invention concerns a process for the preparation of demineralized coal, comprising the steps of:

(a) forming a slurry of coal particles, preferably at least 50% by weight of which particles have a maximum dimension of at least 0.5 mm, with an aqueous solution of an alkali, which solution has an alkali content of from 5 to 30% by weight, such that the slurry has an alkali solution to coal ratio on a weight basis of at least 1:1;

(b) maintaining the slurry at a temperature of from 150° to 300° C., preferably 170° C. to 230° C., for a period of from 2 to 20 minutes substantially under autogenous hydrothermal pressure and rapidly cooling the slurry to a temperature of less than 100° C.;

(c) separating the slurry into alkalized coal and a spent alkali leachant solution;

(d) regenerating the alkali leachant solution for reuse in step (a) above by the addition of calcium or magnesium oxide or hydroxide thereto to precipitate minerals therefrom;

(e) acidifying the alkalized coal by treatment with an aqueous solution of sulphuric or sulphurous acid to yield a slurry having a pH of from 0.5 to 1.5 and a conductivity of from 10,000 to 100,000 μs;

(f) separating the slurry into acidified coal and a spent acid leachant solution; and (g) washing the acidified coal.

13 Claims, 2 Drawing Sheets

DEMINERALIZATION OF COAL

TECHNICAL FIELD

The present invention relates to a process for the preparation of demineralized coal and to demineralized coal produced by such a process.

BACKGROUND ART

Several methods have been described in the literature for producing demineralized or low-ash coal for fuel and other industrial applications, but none have achieved sustained commercial use. Improved processing methods, based on a better understanding of the underlying science, are required in order to foster a successful adoption of chemical cleaning methods for producing superclean coal and its derivatives.

A process was developed in Germany during the 1940's for removing ash-forming mineral matter from physically cleaned black coal concentrates, involving heating the coal as a paste with aqueous alkali solution, followed by solid/liquid separation, acid washing and water washing steps. Reports on this process (1,2) are the earliest accounts known to us of a practical chemical demineralizing method to which the improvements described here may be related. German practice showed that a demineralized coal with an ash yield of 0.28% could be produced from a physically cleaned feed coal which had an ash yield of 0.8%.

The coal-alkali feed paste was stirred at 40°-50° C. for 30 minutes, then pumped through a heat exchanger to a continuously operable gas-heated tubular reactor in which the paste was exposed to a temperature of 250° C. for 20 minutes, under a pressure of 100-200 atmospheres (10-20 MPa). The reaction mixture was then passed through the heat exchanger previously mentioned, in order to transfer heat to the incoming feed, then cooled further in a water-cooled heat exchanger.

The cooled paste was diluted with softened water, then centrifuged to separate and recover the alkaline solution and the alkalized coal. The latter was dispersed into 5% hydrochloric acid, then centrifuged to recover the acidified coal and spent acid, and redispersed in water. The coal was filtered from this slurry, dispersed again in another lot of water and centrifuged to recover the resulting low-ash coal as a damp solid product.

American (3,4) and Indian (5-7) researchers used broadly similar chemical methods, with variations in processing details, to produce low-ash coals from other feed coals, most of which had much higher starting ash levels than the coals that the Germans used. Another American group (at Battelle) claimed advantages for:

(a) Mixed alkali leachants containing cations from at least one element from Group IA and at least one element from Group IIA of the Periodic Table (8,9).

(b) Filtration or centrifugation of the alkalized coal from the spent alkaline leachant, either at the reaction temperature or after rapid cooling to less than 100° C., in order to minimize the formation of undesired constituents, presumably sodalite or similar compounds (9,10), and (c) Application of the process to low-rank coals which dissolve in the alkali and which can be reprecipitated at a different pH from the mineral matter, thus allowing separation and selective recovery (11).

Other researchers have studied scientific aspects of alkaline extraction of sulphur and minerals, including the relative merits of different alkalis (12-14). Most American work has been directed more at the removal of sulphur than metallic elements, and the acid treatment step is often omitted. However, an American group (at Alcoa) has chemically cleaned coal to less than 0.1% ash yield, concurrently achieving large reductions and low final concentrations of iron, silicon, aluminium, titanium, sodium and calcium. The aim was to produce very pure coal suitable for conversion into electrode carbon for the aluminium industry. This was achieved by leaching powdered coal with hot aqueous alkaline solution under pressure (up to 300° C.), then successively with aqueous sulphuric acid and aqueous nitric acid at 70°-95° C. (15-16).

The present inventors' investigations have been conducted with Australian coals, which usually contain less sulphur, but often more ash-forming mineral matter than Northern Hemisphere coals. For practical industrial applications, it would usually be necessary to start with feed coals containing more mineral matter than the coal concentrates that the Germans used, and to remove a larger proportion of it by chemical means so as to obtain products of similar purity.

Like the Germans, the present inventors find that sodium hydroxide solution, unmixed with oxides or hydroxides of Group IIA cations, is an adequate alkaline leachant but they recommend using different alkali concentrations, coal/liquid ratios and leaching conditions. The present inventors anticipate practical difficulties in separating alkalized coal from spent alkaline leachant on an industrial scale at the temperatures and pressures used in the alkaline leaching step as claimed by Battelle (8,9), but acknowledge advantages in rapid cooling before separating the solid and liquid components as claimed by Battelle (9,10) but previously practiced by the Germans (1,2). The present inventors recommend specific ways of conducting the leaching, cooling and separating steps in association with other procedures.

Previous investigators have usually experienced difficulties in achieving very low ash levels, except when starting with clean coal concentrates as feed. Having studied the chemical and physical factors in more detail, the present inventors recommend specific methods and processing conditions, especially involving the acidification and washing procedures, in order to minimize the residual mineral matter left in the demineralized product. They have also found, contrary to expectations and to German practice, that the process will demineralize coarse batches (5-10 mm) to about the same extent and at about the same rate as with fine coal of typical pulverized fuel.

DISCLOSURE OF INVENTION

The present invention consists in a process for the preparation of demineralized coal, comprising the steps of:

(a) forming a slurry of coal particles, preferably at least 50% by weight of which particles have a maximum dimension of at least 0.5 mm, with aqueous solution of an alkali, which solution has an alkali content of from 5 to 30% by weight, such that the slurry has an alkali solution to coal ratio on a weight basis of at least 1:1, (b) maintaining the slurry at a temperature of from 150° to 300° C., preferably 170° C. to 230° C., for a period of from 2 to 20 minutes substantially under autogenous hydrothermal pressure and rapidly cooling the slurry to a temperature of less than 100° C.

(c) separating the slurry into alkalized coal and a spent alkali leachant solution, (d) regenerating the alkali leachant solution for reuse in step (a) above by the addition of calcium or magnesium oxide or hydroxide thereto to precipitate minerals therefrom, (e) acidifying the alkalized coal by treatment with an aqueous solution of sulphuric or sulphurous acid to yield a slurry having a pH of from 0.5 to 1.5 and a conductivity of from 10,000 to 100,000 μs, (f) separating the slurry into acidified coal and a spent acid leachant solution, and (g) washing the acidified coal.

The improvements which are recommended for efficiently demineralizing black coals to very low ash levels may be varied within the ambit of the present invention as appropriate to the circumstances and coal involved. These improvements are not limited in their application to Australian coals but would apply to any other coal with similar characteristics, properties and composition.

In carrying out the process to the present invention, preferred reaction conditions as discussed hereunder are used:

(1) Selection of optimal conditions for the alkali leaching stage in order to maximize dissolution of the mineral matter, to minimize attack on the organic matter, and to minimize the formation of insoluble sodium aluminosilicates on the coal or within its pore structure. These conditions are best provided by (a) Using a slurry or a paste, with an adequate quantity of water to facilitate contact between the alkali and the minerals, and to remove the soluble reaction products and keep them in solution. A minimum liquid:solid ratio of 1:1 is recommended for convenience of stirring and transferring, compared with the German practice of 0.4:1, with preferred ratios ranging from 2:1 to 10:1, the higher ratios being preferred when large amounts of minerals are to be removed. The leachant preferably contains at least a small excess of alkali above the stoichiometric requirements for dissolution of the minerals to be removed; the alkali concentration should be kept at the low end of the 5–30% practical range, preferably in the range of 5–20%, and most preferably in the range of 5–10%.

(b) Avoiding unnecessarily high temperatures. While temperatures of 150°–300° C. are feasible, temperatures of 170°–230° C. are usually adequate to dissolve the commonest minerals, especially clays and quartz. Pyrolysis of the organic matter does not occur in this temperature range, and chemical attack on the organic matter, for instance at phenolic and carboxylic acid groups, is minimal for medium to high rank coals. However, considerable dissolution occurs with low rank coals, which are therefore less suitable for demineralization by this process.

(c) Avoiding unnecessarily long and badly controlled heating. Short residence times of 5–10 minutes at the selected operating temperature are preferred, with minimal heating-up and cooling-down times. This regime can be more easily provided either in a continuous reactor or in batch autoclaves. Long residence times, and leisurely heating and cooling conditions, favor the unwanted side reactions which involve attack on the organic matter and formation of aluminosilicates. However, residence times of up to an hour or more are not excluded, and may be appropriate when low alkaline leaching temperatures are chosen.

(d) Using reasonably coarse coal particles instead of finely ground or pulverized coal. Slurries of coarse particles are easier to process and dewater than slurries of fine particles. Experiments have shown that the aqueous reagents penetrate coarse and fine particles equally well and demineralization varies little with particle size.

(2) Procedures and equipment for conducting the alkaline leaching process may take several forms such as the following:

(a) A desirable procedure to minimize the occurrence of unwanted reactions during the heat-up period comprises heating a relatively concentrated alkali solution and an aqueous coal slurry separately to the desired reaction temperature, then mixing them quickly and thoroughly before allowing the reaction time between them to continue for the desired time. Experience with a small continuous reactor of this type indicates that attack on the minerals is adequate, but attack on the organic matter and formation of sodalite are minimized. In another preferred embodiment of the invention, a previously heated alkali solution is poured onto dry particulate coal.

(b) Suitable leaching reactors may comprise material including tubular concurrent-flow reactors, stirred autoclaves operating batchwise, or with continuous inflow and outflow, in single or multistage configurations, or countercurrent or crossflow systems.

(3) After the comparatively rapid dissolution of quartz and clays has occurred, the relatively slow formation and deposition of sodium aluminosilicates (sodalites) begins to occur from solution. The alkalized coal and spent leachant should preferably be separated quickly after leaving the reactor, in order to minimize contamination of the leached coal by sodalite. Alternative improvements to the standard process are then possible as follows:

(a) The spent leachant is mixed with sufficient calcium oxide or calcium hydroxide to precipitate the soluble silicate and aluminate ions as their insoluble calcium salts, while simultaneously forming soluble sodium hydroxide, thus regenerating the alkaline leachant for recycling. This procedure minimizes the amount of acid needed in the next processing step and hence lowers the total cost of demineralizing the coal. Instead of calcium oxide or hydroxide, the corresponding magnesium salts may be used, or the mixed oxides or hydroxides of calcium and magnesium derived from dolomite may be used.

(b) Recovery of the sodalite by filtration or otherwise may provide a valuable byproduct, while reducing the amount of acid needed to complete the demineralization of the coal. Sodalite may be separated from the alkalized coal by physical methods such as selective screening, heavy media float-sink methods, or froth flotation.

(4) When alkalized coal is acidified with a mineral acid, the sodalite present dissolves to form sodium and aluminium salts and silicic acid. Typically, after removal from the acid leachant, the demineralized coal still gives an ash yield of 0.2–1.0%, and the predominant mineral component in the ash is usually silica. Some of this silica may arise from the soluble silicates and silicic acid rather than from undissolved quartz or siliceous plant material. Improvements to the process are therefore directed at preventing the retention of silicates or the formation of silica gel in the product. This objective can be achieved by the following procedures used individually or in combination:

(a) The alkalized coal is acidified to a pH of about 1 as rapidly as possible, so that the coal experiences only very transitory contact with silicate solutions of near-neutral (pH 7) or strongly acidic (pH $<<1$) reactions, both of which favor formation of silica and alumina gels. It is desirable to add the alkalized coal to an acidic solution of sufficient concentration to ensure that the resulting mixture in maintained as close as possible to pH 1, with rapid and thorough agitation to ensure that this acidic environment is quickly established throughout the porous structure of each particle. Acidification may be carried out batchwise or continuously using this principle.

(b) When the alkalized coal has been acidified, it should be separated as soon as practical from the spent leachant and well washed, preferably using countercurrent techniques.

(c) To further discourage silica gel formation, and the trapping of other minerals by silica in the pore structure of the coal particles, the acidified coal may be first washed with a fresh acid solution of about pH 1 to remove the relatively concentrated solutions of dissolved minerals therefrom by the acid leaching. Optionally, an organic acid with a sufficiently high dissociation constant, such as acetic acid, may be used for this purpose in order to minimize the concentration of inorganic anions remaining on or in the coal. Solutions of ammonium salts are also useful for washing out residual minerals. The final washing is carried out with water, which may be deionized by established methods before use.

BRIEF DESCRIPTION OF THE DRAWING

Hereinafter given by way of example only is a preferred embodiment of the present invention described with reference to the accompanying drawings in which.

THE BEST MODE OF CARRYING OUT THE INVENTION

EXAMPLE NO. 1

Figure 1:
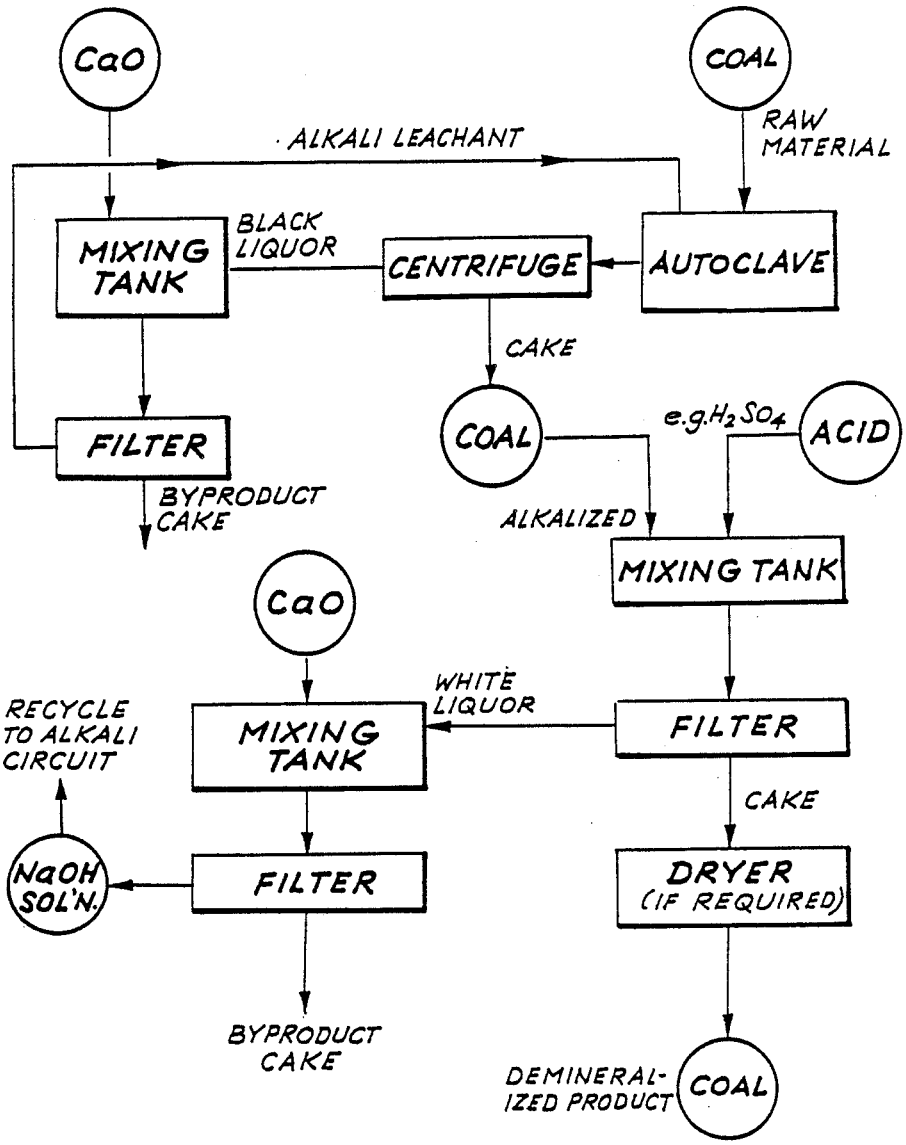
FIG. 1 is a flow sheet showing the steps of the process according to the present invention.
Figure 2:
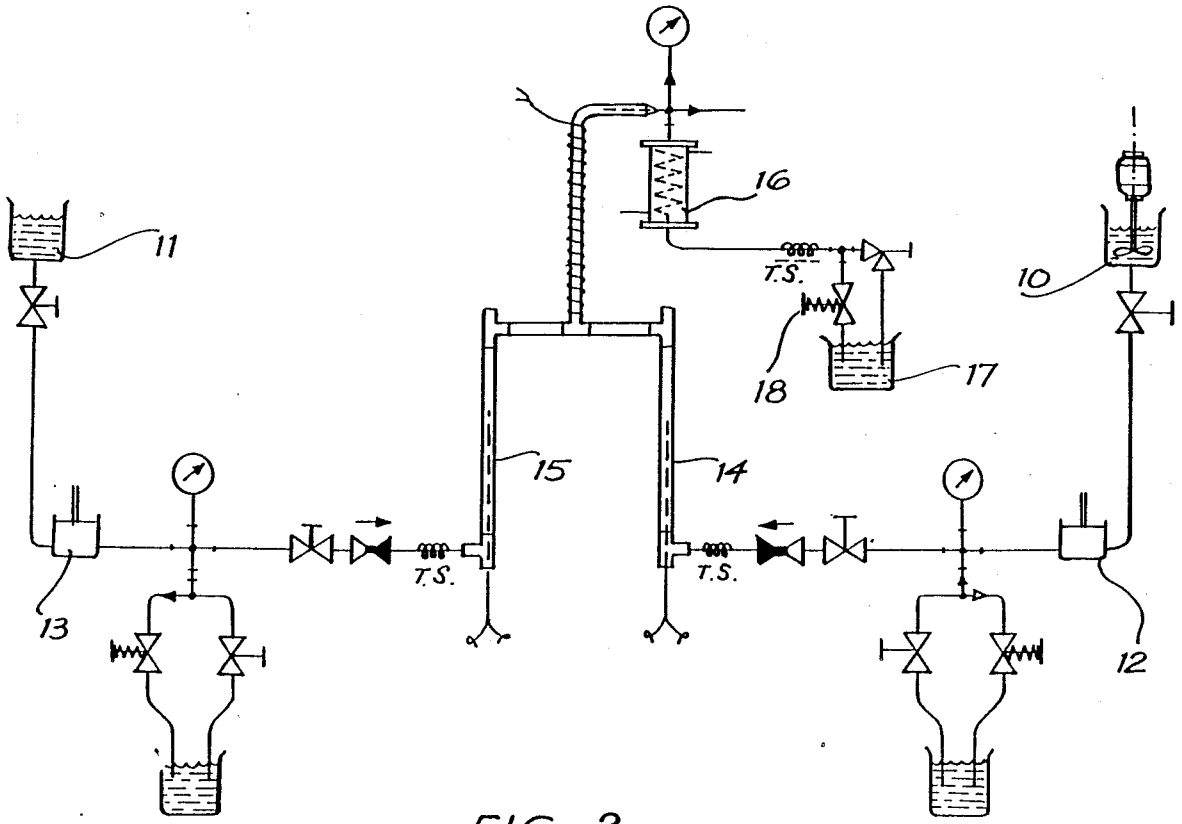
FIG. 2 is a diagrammatic representation of laboratory apparatus simulating.

A 1 kg sample of Liddell Foybrook coal with an ash yield of 8.5% (particle size—200 um) was slurried with 2.5 L of water and stirred in a holding tank 10. A second solution of 20% w/w of NaOH was contained in a second tank 11. Both the coal slurry and caustic solution were pumped separately via metering pumps 12 and 13 at 3.5 and 25 liters/hr, respectively, and heated to 200° C. with electrical immersion heaters 14 and 15 respectively. The two solutions were mixed in a 500 ml stainless steel pressure vessel 16 and the solution maintained at 200° C. for the duration of the slurry in the vessel, approximately 5 min. The alkali coal slurry was rapidly cooled to room temperature and collected in container 15 after leaving the pressure relief valve 18.

The slurry was filtered on a Buchner funnel and washed with water to remove excess alkali. A small sample of the washed coal was dried and the ash level determined by standard techniques. The ash yield, which was comprised of mainly sodalite, was 7.3%.

The filtrate was pale in color, and, after acidifying a 20 ml portion, a precipitate was collected which represented $<0.05\%$ of the coal.

The remaining coal filter cake from the Buchner funnel was treated with 0.1M sulphuric acid and maintained at pH of 1 with sufficient water to give a conductivity reading of 50,000 $\mu$S. The mixture was stirred for 45 minutes then filtered and washed with distilled water until the filtered solution had a conductivity of $<10$ $\mu$S. A sample of the coal was then dried and an ash yield determined. The demineralized Liddell coal had an ash yield of 0.5%.

The bulk of the alkali liquor from the initial filtration was treated with 100 gm of lime $Ca(OH)_2$ and stirred for 2 hours, then filtered. The liquor (still slightly colored) was analyzed for silicon content and if $<200$ ppm was used for subsequent leaching studies.

EXAMPLE NO. 2

A 100 gm sample of Liddell Foybrook coal, with an ash yield of 8.5% (particle size—200 $\mu$m) was slurried with 300 mls of 15% caustic soda solution and placed in a 1 L stainless steel autoclave. The autoclave was heated to 200° C. over 35 minutes then allowed to cool to 80° C. over 1½ hours and the slurry then recovered from the autoclave. After filtering the slurry in a Buchner filter the filtrate was darkly colored due to dissolved humic acids. The amount of humic acids was determined by acidifying a 20 ml portion of the liquor and filtering to collect the precipitated organics. After weighing the precipitate the percentage of dissolved coal was calculated at 1%. This filtrate which contained mainly sodium silicate and excess caustic was treated with lime $Ca(OH)_2$ and stirred for 2 hours. When the concentration of silicon in solution had dropped from the initial concentration of 2000 ppm to $<200$ ppm the lime treated slurry was filtered and the regenerated caustic solution (black liquor) was reused for further leaching studies. The alkalized filter cake coal after washing, to remove excess caustic was slurried with 200–250 ml water and acidified to pH of 1 with sulphuric acid. Conductivity of this solution measured 25,000 $\mu$S. After 45 minutes, this slurry was filtered and washed with distilled water until the conductivity was $<10$ $\mu$S. The ash yield of this demineralized Liddell coal was 0.60%.

EXAMPLE NO. 3

Example 2 was repeated using coal feed which had a particle size distribution of less than 3 mm with 50% of solids between 3 and 0.5 mm and 50% less than 0.5 mm. The coal filter cake after separation of the alkali solution was treated as in Example 2.

Five kilograms of coarse alkalized coal prepared as in the above method was found to have an ash yield of 11.3% (mostly sodalite). Froth flotation of this coal was performed in a conventional laboratory scale test unit using diesel oil (0.1%) and methyl isobutyl carbinol (0.01%) frothing agent, and an air flow sufficient to give a good froth without excess turbulence. The ash yield dropped from 11.3% to 6.3% ash.

A similar set of experiments was run to collect a quantity of coarse alkalized coal and several kilograms of the coarse alkalized coal was washed in a countercurrent wash unit at the rate of 12 kg coal/hr washed with 24 kg of water/hr. Under these conditions, fine underflow material was collected in the waste water, which was rich in sodalite, as indicated by the ash yield which was 73% sodalite.

These two steps are important in that they recover sodalite-rich concentrates and reduce the quantity of acid necessary for subsequent acidification of the coal.

The details of the process and the importance of the respective process parameters essential to this invention may be better understood by reference to the following examples drawn from extensive laboratory and small rig studies.

EXAMPLE NO. 4

Experiments showed that a caustic coal paste is as efficient as a diluted solution for removing the mineral matter from coal, provided sufficient caustic soda is present. Sufficient water should be provided to achieve adequate stirring and transportation and transfer of material, preferably a 30% slurry. In practice, a maximum slurry concentration of 50% has been found.

Ash removal from a Vaux steam coal treated at 200° C. under the following conditions is shown below:

| | Residence time at 200° C. | Slurry Concentration | % Mineral Removed |
|---|---|---|---|
| Vaux fine coal (floats containing 2.4% ash) | 2 min. | 70 | 48 |
| | | 35 | 46 |
| Vaux fine coal (sinks containing 14.2% ash) | 2 min. | 70 | 83 |
| | | 35 | 84 |
| Vaux coarse coal (floats containing 2.4% ash) | 30 min. | 70 | 58 |
| | | 35 | 54 |
| Vaux coarse coal (sinks containing 14.2% ash) | 30 min. | 70 | 88 |
| | | 35 | 85 |

EXAMPLE NO. 5

A Liddell seam coal with 9.3% ash yield, treated at 200° C., at a slurry concentration of 29% with varying alkali concentration gave the following % mineral removal:

| Mole Ratio of NaOH:Ash (assuming ash is all $SiO_2$) | Slurry Conc. (% solids loading) | % Mineral removed |
|---|---|---|
| 1:1 (5%) | 29 | 50 |
| 2.5:1 (5%) | 29 | 81 |
| 8:1 (5%) | 29 | 87 |

The results show that to achieve significant mineral removal, the caustic soda concentration should be greater than stoichiometric.

EXAMPLE NO. 6

A sample of Coal Cliff coal was processed with alkali over a range of temperatures with subsequent treatment with acid and the ash levels were measured as follows:

| Coal-Coal Cliff (20% ash db), Particle Size - −2mm, NaOH-15% | |
|---|---|
| Temperature | Ash % (db) |
| 150 | 4.6 |
| 220 | 2.2 |

-continued

| Coal-Coal Cliff (20% ash db), Particle Size - −2mm, NaOH-15% | |
|---|---|
| Temperature | Ash % (db) |
| 260 | 2.3 |
| 300 | 2.5 |

The % mineral removal from a Piercefield seam coal in a 50% slurry at different temperatures is shown below:

| Temperature | % Mineral Removal |
|---|---|
| Piercefield Floats (2.6% ash) | |
| 170 | 36 |
| 200 | 64 |
| 250 | 83 |
| Piercefield Rejects (12.9% ash) | |
| 170 | 63 |
| 200 | 83 |
| 250 | 90 |

EXAMPLE NO. 7

Experiments carried out with a wide range of coals showed that the amount of organic matter dissolved varied considerably with rank, and increased with temperature.

| Coal Name (Ash % db) | | % Coal Dissolved at the Various Temperatures of Alkali Leaching | | | |
|---|---|---|---|---|---|
| | | 150° | 220° | 260° | 300° |
| Dawson | 8.3 | Nil | Nil | Nil | Nil |
| Coal Cliff | 20.0 | Nil | Nil | Nil | Nil |
| Bowen | 15.6 | 0.005 | 0.18 | — | 0.67 |
| Huntley | 23.8 | Nil | Nil | Nil | Nil |
| Wongawilli | | | | | |
| Great Northern | 22.0 | — | 0.47 | — | 1.68 |
| Newvale | | | | | |
| Cook | 10.0 | Nil | Nil | Nil | — |
| Ulan | 17.6 | Nil | 0.30 | 0.50 | — |
| Liddell | 8.7 | Nil | 0.11 | 0.72 | — |
| Blair Athol | 8.2 | 0.07 | 1.07 | — | — |
| Collie | 4.6 | 0.75 | — | — | — |
| Wandoan | 8.2 | 2.10 | — | — | — |
| Leigh Creek | 13.6 | 3.97 | — | — | — |
| Esperance | 25.8 | 8.63 | — | — | — |

Nil - color detected in solution but too small to measure accurately.
— - experiment not attempted.

EXAMPLE NO. 8

The advantage of rapid heating and cooling is that there is less attack on the coal (i.e., as measured by the quantity of dissolved coal) and the quantity of sodalite formed is less. A Liddell seam coal was heated slowly up to 200° C. and cooled slowly over a period of 2 hours. Analyses for dissolved organics and ash content of alkalized coals were compared with results for the same coal treated with rapid heating and cooling. The results indicate a marked improvement for the latter method.

| Slow Heating and Cooling (2 hours) | | Rapid Heating and Cooling (10 min.) | |
|---|---|---|---|
| Dissolved Organics | Alkali Ash (sodalite) | Dissolved Organics | Alkali Ash (sodalite) |
| Liddell Seam Coal (5.6% db), Particle Size - 200 μm | | | |
| 1.30% | 7.0 | Nil* | 4.2 |

-continued

| Slow Heating and Cooling (2 hours) | | Rapid Heating and Cooling (10 min.) | |
|---|---|---|---|
| Dissolved Organics | Alkali Ash (sodalite) | Dissolved Organics | Alkali Ash (sodalite) |
| Ulan Coal (17.6% db), Particle Size - 200 μm | | | |
| 0.86% | 11.6 | Nil* | 5.0 |

Nil - too small to be collected on filter paper (but slight coloration of liquor).

EXAMPLE NO. 9

Ulan coal (17.6% db) washed to −2 mm was demineralized using alkali in a typical batch experiment at 220° C. peak temperature, following by acidification and washing. The product was separated into closely sized fractions, and the percentage mineral removed was calculated for each fraction from the ash yield. The following data were obtained showing substantially the same mineral matter for each fraction. Minor variations occurred in the largest and smallest sizes because the largest size contained some insufficiently dissolved quartz grains and the smallest size contained a high proportion of iron formed by concentration of fine hematite derived from the conversion of pyrites.

| Particle Size Fraction | % Mineral Removed |
|---|---|
| +1.4 mm | 93.8 large quartz grains |
| −1.4 mm + 500 μm | 96.3 |
| −500 μm + 425 μm | 97.7 |
| −425 μm + 300 μm | 97.1 |
| −300 μm + 250 μm | 97.1 |
| −250 μm + 150 μm | 97.3 |
| −150 μm + 75 μm | 96.3 |
| −75 μm | 94.4 high iron |

EXAMPLE NO. 10

| Coal - Liddell (8.6% db), Particle Size - 200 μm | | | |
|---|---|---|---|
| | Liquor Analysis | | Solid Analysis |
| | Before Lime | After Lime | Lime Filter Cake |
| | mg/L | | % |
| Si | 2300 | 125 | 1.3 |
| Al | 105 | 50 | 0.09 |
| Fe | 9.2 | 0.08 | 0.08 |
| Ti | 8.0 | 0.11 | 0.01 |
| Ca | 290 | 11.3 | 45.9 (excess lime) |
| Mg | 0.15 | 0.47 | 0.47 |
| Na | 72.8 g/L | 79.7 g/L | 0.004 |
| K | 165 | 290 | 0.004 |

EXAMPLE NO. 11

To calculate the rate of lime reaction in regenerating the black liquors, 350 g of Vaux seam coal and 1 L 16% NaOH autoclaved at 230° C. liquor filtered and limed 100 g.

| Time | Si mg/L | Al mg/L | Na g/L | K mg/L |
|---|---|---|---|---|
| 0 | 2970 | 19.0 | 47.5 | 157 |
| 15 min. | 560 | 4.5 | 46.3 | 190 |
| 30 min. | 330 | 3.9 | 46.3 | 186 |
| 1 hour | 195 | 4.5 | 46.3 | 172 |
| 2 hours | 120 | 4.9 | 45.7 | 180 |
| 4 hours | 85 | 5.2 | 46.3 | 186 |
| 6 hours | 60 | 5.7 | 47.0 | 186 |
| 24 hours | 55 | 6.0 | 47.0 | 172 |

EXAMPLE NO. 12

Sodalite concentrates can be collected in the fines under flow fraction from conventional countercurrent washing units.

Coal—Liddell (8.6% db), Particle Size −2 mm with 95% −1.4 mm +300 μm.

Sodalite Content of Fines——100 μm is 80.5% db.

EXAMPLE NO. 13

The quantity of sodalite on the alkalized coal can be removed by conventional froth flotation techniques, as shown below:

Coal—Ulan (12.6% db), Particle Size −2 mm.

Ash yield (sodalite concentration) of the alkalized coal=10.36% db. After froth flotation, the ash yield of treated coal floats=5.29% db. The separated sodalite appears in the flotation sinks fraction.

EXAMPLE NO. 14

Practically all acidified samples of silicic acid form gels if left to age. The most favorable conditions where gel formation takes a long time are described below:

If the solutions are maintained at a pH of approximately 1 with a corresponding conductivity of between 10,000 and 50,000 μS (microsiemens), gel formation can be avoided. If the concentration of dissolved salts increases the conductivity above 200,000 by adding more acid or dissolved sodalite salts, then clear gels form slowly over a day or so. Between 50,000–200,000 μS clear gels form over a week.

If the acid strength is a pH of 0.1 or lower and the quantity of sodalite is high, then opaque gels form immediately. Again, if the pH is near neutral, milky gels form with some precipitation and a liquid phase is formed.

To obtain the optimum condition for prevention of gel formation in a coal sample, a general formula is as follows: If a coal contains between 6–9% sodalite and is mixed with a quantity of water twice the weight of coal and maintained at a pH close to 1, then gel formation does not occur within the time required to dissolve the sodalite and wash the acidified coal. If the sodalite concentration is twice as high or the quantity of water halved, then gel formation may occur in a day. (Ideal conditions are pH=1 and conductivity=50,000 μs.)

REFERENCES

1. Crawford, A., 1946. "The de-ashing of coal by combined jig washing, froth-flotation, and extraction with caustic soda". Brit. Intell. Object. Subcomm. Final Report No. 522, Item no. 30.

2. Crawford, A., 1951. "The preparation of ultra-clean coal in Germany". Trans. Inst. Min. ENg. 111, 204.

3. Reggel, L., Raymond, R., Wender, I. and Blaustein, B. D., (1972). "Preparation of ash-free, pyrite-free coal by mild chemical treatment". Amer. Chem. Soc., Div. Fuel Chem., Preprint, 17, 44.

4. Reggel, L., Raymond, R. and Blaustein, B. D., (to U.S. Dept. of Interior), (1973). "Removal of mineral matter including pyrite from coal". U.S. Pat. No. 3,993,455, November 23rd.

5. Central Fuel Research Institute, India (1980). Indian Patent Application No. 774/Del/1980. (Outcome of application not known).

6. Mazumdar, B. K. (1983). "Demineralisation of coal—an overview". Chem. Engng World 18(6), 100–106.
7. Swamy, Y. V., Chandra, D. and Chakrabarty, J. N., (1984). "Removal of sulphur from Indian coals by sodium hydroxide leaching". J. Inst. Energy 57, 438–443.
8. Stambaugh, E. P. and Sachsel, G. F. (to Battelle Memorial Inst.) (1975). "Extracting sulfur and ash". U.S. Pat. No. 4,055,400, April 7th.
9. Stambaugh, E. P. and Chauhan, S. P. (to Battelle Memorial Inst.) (1975). "Treating solid fuels". Australian Patent No. 500,736, (March 31st).
10. Stambaugh, E. P. and Chauhan, S. P. (to Battelle Memorial Inst.) (1976). "Fuel separation process". U.S. Pat. No. 4,095,955 (May 5th).
11. Stambaugh, E. P. (to Battelle Memorial Inst.) (1977). "Treating carbonaceous material". U.S. Pat. No. 4,121,910, (July 18th).
12. Wheelock, T. D., (1981). "Oxydesulfurization of coal in alkaline solutions". Chem. Eng. Commun. 12, 137–159.
13. Wheelock, T. D. and Markuszewski, R., (1984). Coal preparation and cleaning, in "The Science and Technology of Coal and Coal Utilization", Chap. 3 (Eds. Cooper, B. R. and Ellingson, W. A.). Plenum Press, NY and London, pp. 101–105.
14. Fan, C. W., Markuszewski, R. and Wheelock, T. D., (1985). "Effect of alkaline leaching conditions on coal mineral matter". Proc. 3rd Intern. Conf. Coal sci., Sydney, October 28–31st.
15. Yang, R. T., (to Aloca, U.S.A.) (1979). "High-purity coal). U.S. Pat. No. 4,134,737, (January 16th).
16. Yang, R. T., Das, S. L. and Tsai, M. C. (1985). "Coal demineralisation using sodium hydroxide and acid solutions". Fuel, 64, 735–742.
17. Waugh, A. B. and Bowling, K. McG., (1984). "Removal of mineral matter from bituminous coals by aqueous chemical leaching". Fuel Process. Technol. 9, 217–233.
18. Waugh, A. B. and Bowling, K. McG., (1984). "The preparation of clean coal". Proc. Aust. Coal Sci. Conf., Churchill, Victoria, December 3–5, pp. 175–181.
19. Bowling, K. McG. and Waugh, A. B., (1985). "Demineralisation—a new approach to old problems in the utilization of solid fuels". Proc. Aust. Inst. Energy, Natl. Conf., Melbourne, August 27–29, 1985, pp. 347–358.

We claim:

1. A process for the preparation of demineralized coal, comprising the steps of:

(a) forming a slurry of coal particles with an aqueous alkali solution having an alkali content of from 5 to 30% by weight, such that said slurry has an alkali solution to coal ratio on a weight basis of at least 1:1;

(b) maintaining said slurry at a temperature of from 150° to 300° C. for a period of from 2 to 20 minutes substantially under autogenous hydrothermal pressure and rapidly cooling said slurry to a temperature of less than 100° C.;

(c) separating the slurry into alkalized coal and a spent alkali leachant solution;

(d) regenerating said alkali leachant solution for reuse in step (a) above by addition of calcium or magnesium oxide or hydroxide thereto to precipitate minerals therefrom;

(e) acidifying said alkalized coal by treatment with an aqueous solution of sulfuric or sulfurous acid to yield a slurry having a pH of from 0.5 to 1.5 and a conductivity of from 10,000 to 100,000 μs;

(f) separating the slurry of step (e) into acidified coal and a spent acid leachant solution; and (g) washing the acidified coal.

2. A process as claimed in claim 1, wherein said slurry of coal and aqueous alkali solution has an alkali solution to coal ratio on a weight ratio of from 2:1 to 10:1.

3. A process as claimed in claim 1, wherein said alkali/coal slurry is maintained at a temperature of from 170° to 230° C. for a time of from 5 to 10 minutes.

4. A process as claimed in claim 1, wherein the alkali/coal slurry is maintained at a temperature of from 170° to 230° C.

5. A process as claimed in claim 1, wherein the alkali is selected from the group comprising sodium hydroxide, potassium hydroxide and mixtures thereof.

6. A process as claimed, in claim 1, wherein the alkali/coal slurry is formed in a countercurrent reactor.

7. A process as claimed in claim 1, wherein said alkali solution has an alkali content of from 5 to 10% by weight.

8. A process as claimed in claim 1, wherein the alkali/coal slurry is held at a temperature of from 120° to 150° C. prior to being heated to, and maintained at a temperature of from 170° to 230° in step (b).

9. A process as claimed in claim 8, wherein a physical separation step is carried out between steps (c) and (e) to remove discrete particles of sodalite and other reaction products of said alkali solution and said coal.

10. A process as claimed in claim 1, wherein said alkalized coal is acidified by being introduced into an acid solution containing sufficient acid to produce the desire pH and conductivity stated in step (e).

11. A process as claimed in said claim 1, wherein acidified coal is washed with a solution of an organic acid and is subsequently washed with deionized water.

12. A demineralized coal obtained by a process as claimed in claim 1.

13. A process as claimed in claim 1, wherein at least 50 wt. % of said coal particles used to form said slurry of step (a) have a particle size of at least 0.5 mm.

* * * * *